US006786162B1

(12) United States Patent
Volkmer et al.

(10) Patent No.: US 6,786,162 B1
(45) Date of Patent: Sep. 7, 2004

(54) SPACE-SAVER WORKBENCH

(76) Inventors: Randy E. Volkmer, 1705 E. 56th St., Kearney, NE (US) 68847; Allan J. Arnold, 2965 E. 102nd St., Kearney, NE (US) 68847

( * ) Notice: Subject to any disclaimer, the term of this patent is extended or adjusted under 35 U.S.C. 154(b) by 59 days.

(21) Appl. No.: 10/369,898

(22) Filed: Feb. 20, 2003

(51) Int. Cl.[7] ..... A47B 3/00
(52) U.S. Cl. ..... 108/115; 108/48; 108/136
(58) Field of Search ..... 108/48, 35, 36, 108/134, 42, 136; 312/248; 211/90, 99, 104; D6/429, 430

(56) References Cited

U.S. PATENT DOCUMENTS

| | | | | |
|---|---|---|---|---|
| 1,054,894 A | | 3/1913 | Ball | |
| 1,213,832 A | | 1/1917 | Brandt | |
| 1,632,939 A | | 6/1927 | Williams | |
| 1,753,423 A | | 4/1930 | Kroschel | |
| 1,776,204 A | | 9/1930 | Tascarella | |
| 1,767,363 A | * | 12/1930 | Fahnestock | 108/115 |
| 1,949,405 A | | 3/1934 | Bailey | 45/51 |
| 2,647,811 A | | 8/1953 | Norris, Jr. | 311/19 |
| 3,080,832 A | | 3/1963 | Schroemges | 180/13 |
| 3,318,269 A | | 5/1967 | Kinn | 108/112 |
| 3,675,594 A | * | 7/1972 | Kritske | 108/2 |
| 4,155,609 A | | 5/1979 | Skafte et al. | 312/245 |
| D263,533 S | | 3/1982 | Ferdinand et al. | D6/178 |
| 5,067,535 A | | 11/1991 | Wolff | 144/286 R |
| 5,544,592 A | * | 8/1996 | Leezer | 108/48 |
| 6,039,416 A | | 3/2000 | Lambert | 312/245 |
| 6,405,392 B2 | * | 6/2002 | Schwalbe, Jr. | 5/136 |

FOREIGN PATENT DOCUMENTS

EP 1057595 * 5/2000

* cited by examiner

*Primary Examiner*—Janet M. Wilkens
(74) *Attorney, Agent, or Firm*—Thomte, Mazour & Niebergall; Dennis L. Thomte

(57) ABSTRACT

A space-saver workbench is disclosed which is pivotally movable between a work position wherein the table thereof is in a horizontal position to a stored position wherein the table portion thereof is in a vertically disposed position. A pair of springs are operatively connected to the table portion to provide a lift assist for moving the table portion from its horizontal position to its vertically disposed position. The springs also assist in maintaining the table portion in its stowed position. When the table portion is in the stowed position, it is spaced outwardly from a wall or the like sufficient so that the table portion will not interfere with tools hanging on a pegboard positioned adjacent the table portion.

28 Claims, 5 Drawing Sheets

SPACE-SAVER WORKBENCH

BACKGROUND OF THE INVENTION

1. Field of the Invention

This invention relates to a folding workbench or table and more particularly to a space-saver workbench or table which may be easily moved between work and stored positions.

2. Description of the Prior Art

Many types of folding workbenches and tables have been previously provided. See, for example, U.S. Pat. Nos. 1,213,832; 1,632,939; 1,753,423; 1,776,204; 1,949,405; 2,647,811; 3,080,832; 3,318,269; 4,155,609; 5,067,535; and 6,309,416. See also U.S. Des. Pat. No. 263,533. In many instances, the workbench is used in a garage or shop wherein a sheet or sheets of pegboard are secured to a wall with the pegboard supporting a plurality of tools or the like thereon. Further, in many instances, the workbench will have a vise secured thereto. If the table portion of the prior art folding workbenches are folded or pivoted upwardly from a horizontal work position to an upright stored or folded position, the tools on the pegboard will interfere with the same. Additionally, the prior art is not believed to provide an adequate spring lift assist for the bench which also yieldably maintains the bench in its folded position. Additionally, the prior art folding tables and benches seem to be rather complex in design and are usable in only one particular location.

SUMMARY OF THE INVENTION

The space-saver workbench of this invention comprises a framework having an upper end, a lower end, a rearward side and a forward side. The framework may be secured to a wall or the floor for stability purposes. First and second legs are provided at the forward side of the framework with the upper ends thereof being disposed above the upper end of the framework. First and second arms are pivotally secured at one end thereof to the first and second legs above the lower ends thereof. The other ends of the first and second arms are pivotally secured to third and fourth legs above the lower ends thereof.

The upper ends of the first and second legs are pivotally secured to the bottom surface of a table portion forwardly of the rearward end thereof. The upper ends of the third and fourth legs are pivotally secured to the bottom surface of the table portion adjacent the forward end thereof. A pair of elongated springs are secured to and extend between the lower forward end of the framework and the rearward end of the table portion.

The table portion is selectively movable between a horizontal work position to an upright stored position. The springs provide a lift assist when moving the table portion from its work position to its stored position. The springs also yieldably maintain the table portion in its stored position. When in the stored position, the table portion is spaced several inches from the wall.

A principal object of the invention is to provide a space-saver workbench or table.

A further object of the invention is to provide a space-saver workbench which does not objectably protrude from a wall when in its stored position.

A further object of the invention is to provide a space-saver workbench which has a spring lift assist.

Yet another object of the invention is to provide a space-saver workbench which includes a spring which yieldably maintains the bench in its stored position.

Still another object of the invention is to provide a space-saver workbench which may support a vice thereon.

A further object of the invention is to provide a space-saver workbench which has adjustable front legs to compensate for an uneven floor.

A further object of the invention is to provide a space-saver workbench which has no complex parts.

A further object of the invention is to provide a space-saver workbench which is economical of manufacture, durable in use and refined in appearance.

These and other objects will be apparent to those skilled in the art.

DESCRIPTION OF THE PREFERRED EMBODIMENT

Figure 1:
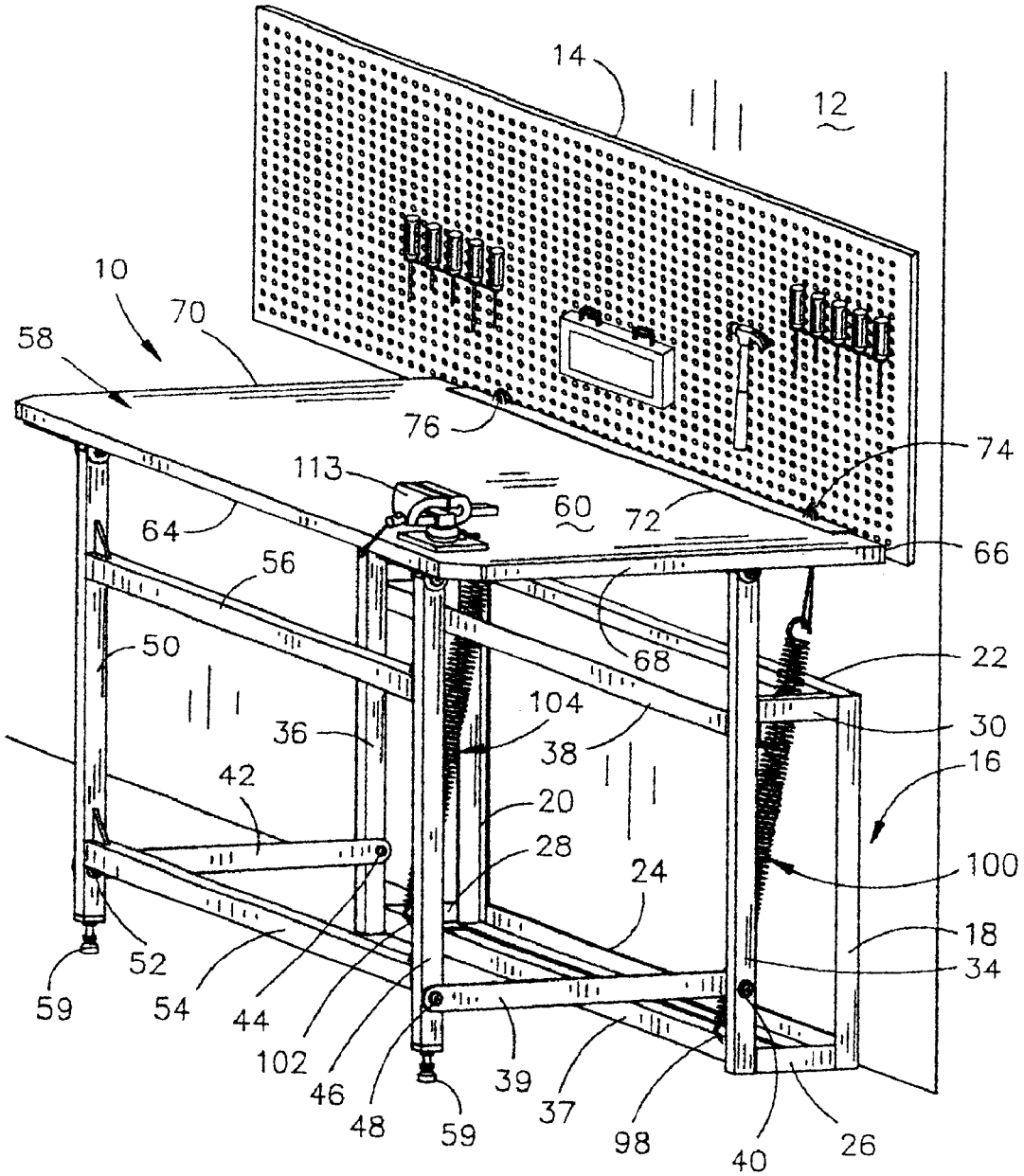
FIG. 1 is a front perspective view of the space-saver workbench of this invention positioned adjacent a wall having a pegboard thereon with the workbench being in its work position.
Figure 2:
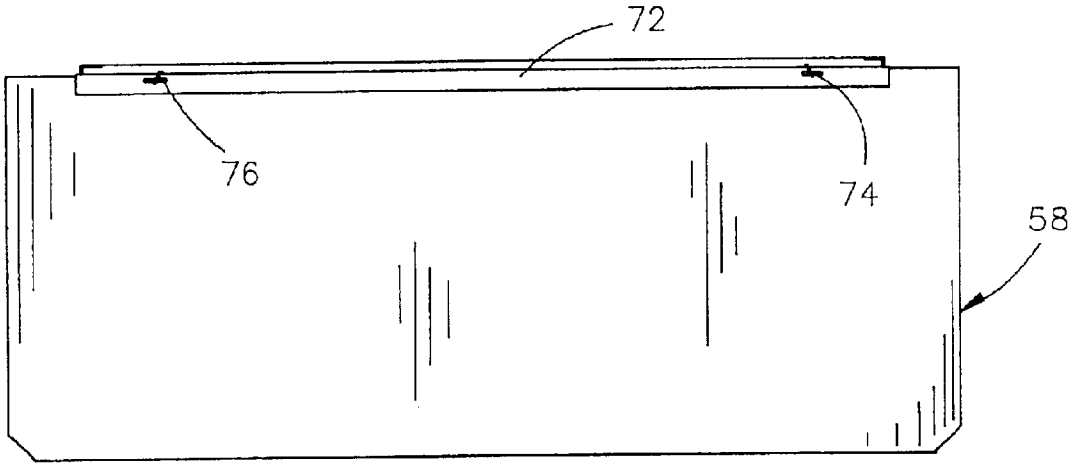
FIG. 2 is a top view of the workbench of this invention in its work position.
Figure 3:
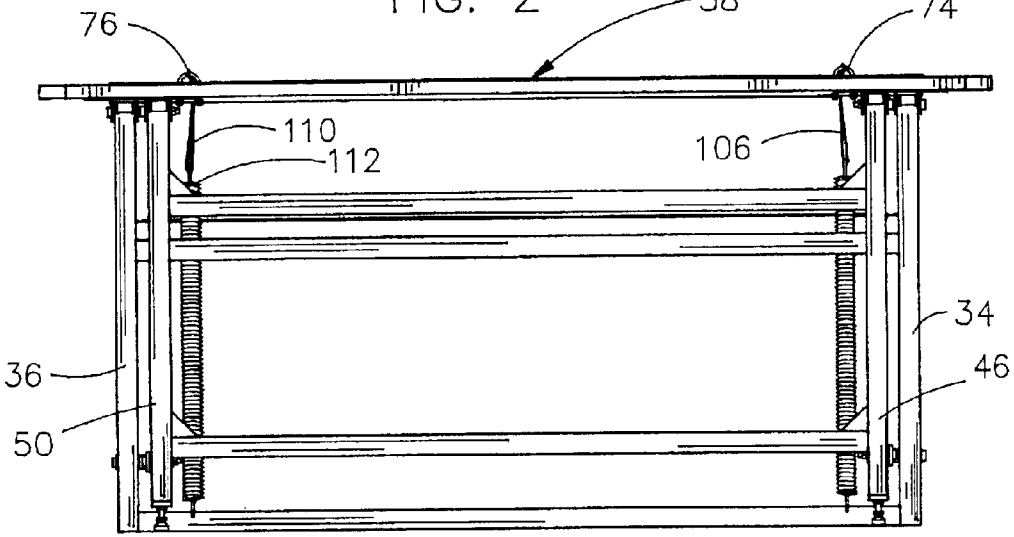
FIG. 3 is a front view of the workbench of this invention in its work position.
Figure 4:
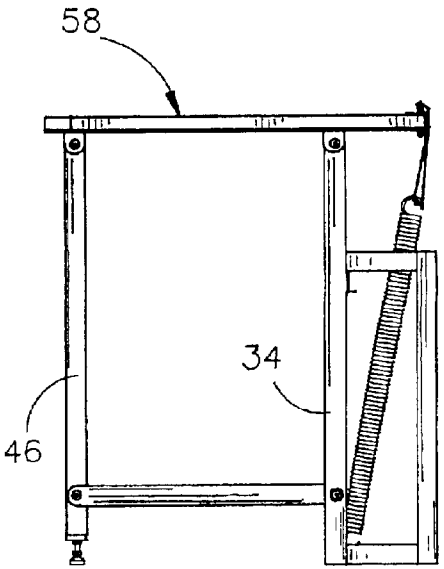
FIG. 4 is a side view of the workbench of this invention in its work position.
Figure 5:
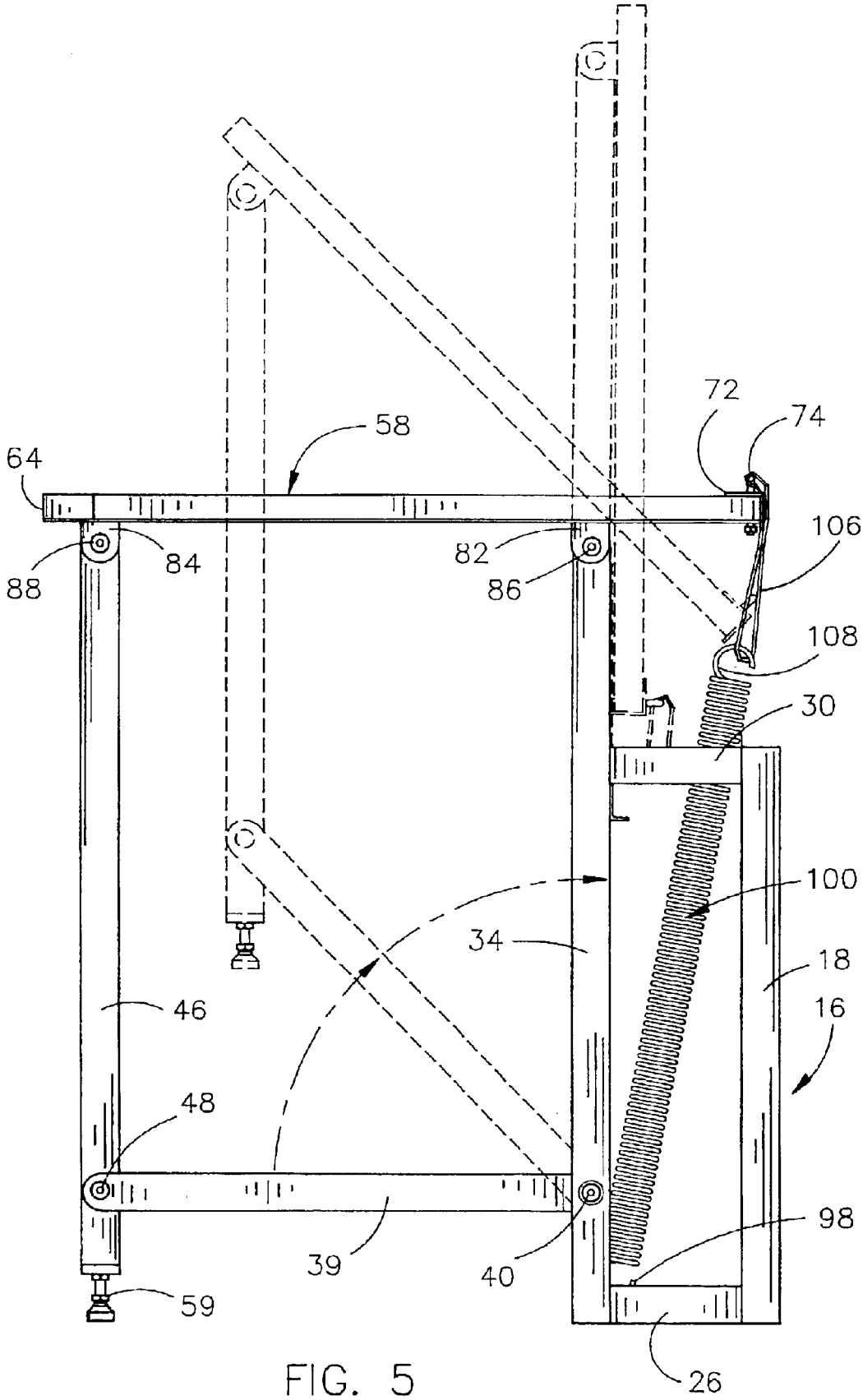
FIG. 5 is a side view of the workbench of this invention in its work position with the broken lines illustrating the movement of the bench from its work position to its stored position.

The space-saver workbench of this invention is referred to generally by the reference numeral 10 and is designed to be positioned adjacent a wall 12 and which may have a pegboard 14 mounted thereon above the workbench 10 for storing tools, etc., thereon. Workbench 10 includes a base unit or framework 16 which is preferably secured to the wall 12 by screws, bolts, anchors, etc. If desired, base unit 16 could be secured to the floor.

Base unit 16 includes a pair of upstanding frame members 18 and 20 having a brace 22 secured to the upper ends thereof and which extends therebetween (FIG. 1). Brace 24 is secured to the lower ends of frame members 18 and 20 and extends therebetween (FIG. 1). Frame members 26 and 28 are secured to the lower ends of frame members 18 and 20, respectively, and extend horizontally therefrom in a forwardly direction away from wall 12. Frame members 30 and 32 are secured to the upper ends of frame members 18 and 20, respectively, and extend horizontally therefrom in a forwardly direction away from wall 12.

Base unit 16 also includes a vertically disposed frame member or leg 34 which is secured to the forward ends of frame members 26 and 30. Base unit 16 further includes a vertically disposed frame member or leg 36 which is secured to the forward ends of frame members 30 and 32. Braces 37 and 38 are secured to legs 34 and 36 and extend therebetween. Elongated arm 39 is pivotally secured at one end thereof to leg 34 by bolt assembly 40. Elongated arm 42 is pivotally connected at one end thereof to leg 36 by bolt assembly 44. The other end of arm 39 is pivotally connected to leg 46 by bolt assembly 48. The other end of arm 42 is pivotally connected to leg 50 by bolt assembly 52. Braces 54 and 56 are secured to legs 46 and 50 and extend therebetween (FIG. 1). The pivotal connection of the legs 46 and 50 to the legs 34 and 36 is such that the legs 46 and 50 will be positioned between the legs 34 and 36, respectively, when the workbench is in its stored or stowed position as will be described hereinafter. The lower ends of legs 46 and 50 have adjustable levelers 59 provided thereon. (FIG. 1).

Figure 6:
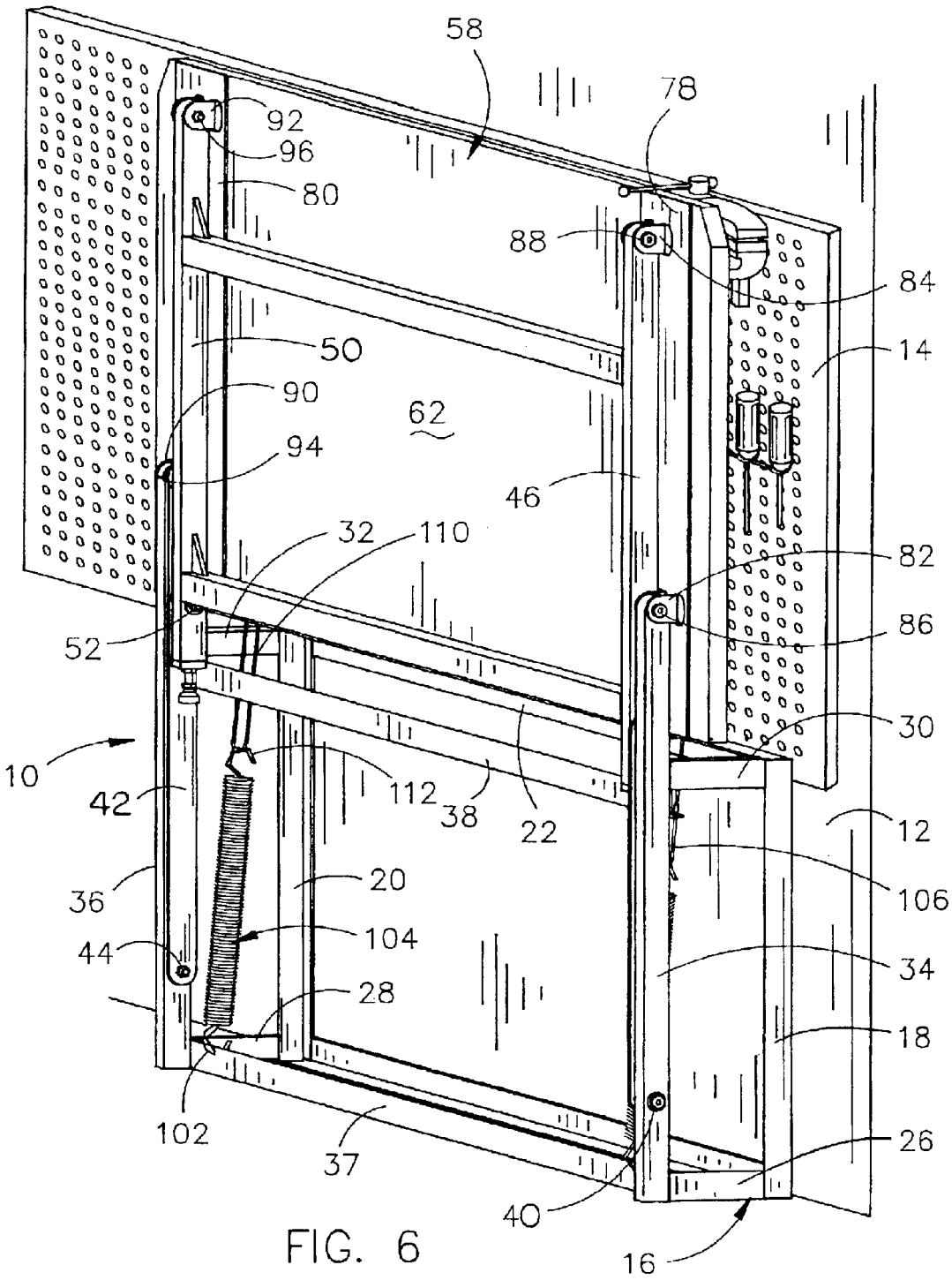
FIG. 6 is a front perspective view of the workbench in its stored or folded position.
Figure 7:
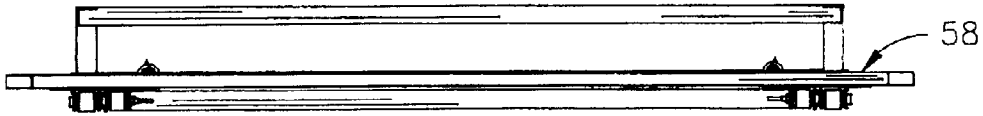
FIG. 7 is a top view of the workbench in its stored position.
Figure 8:
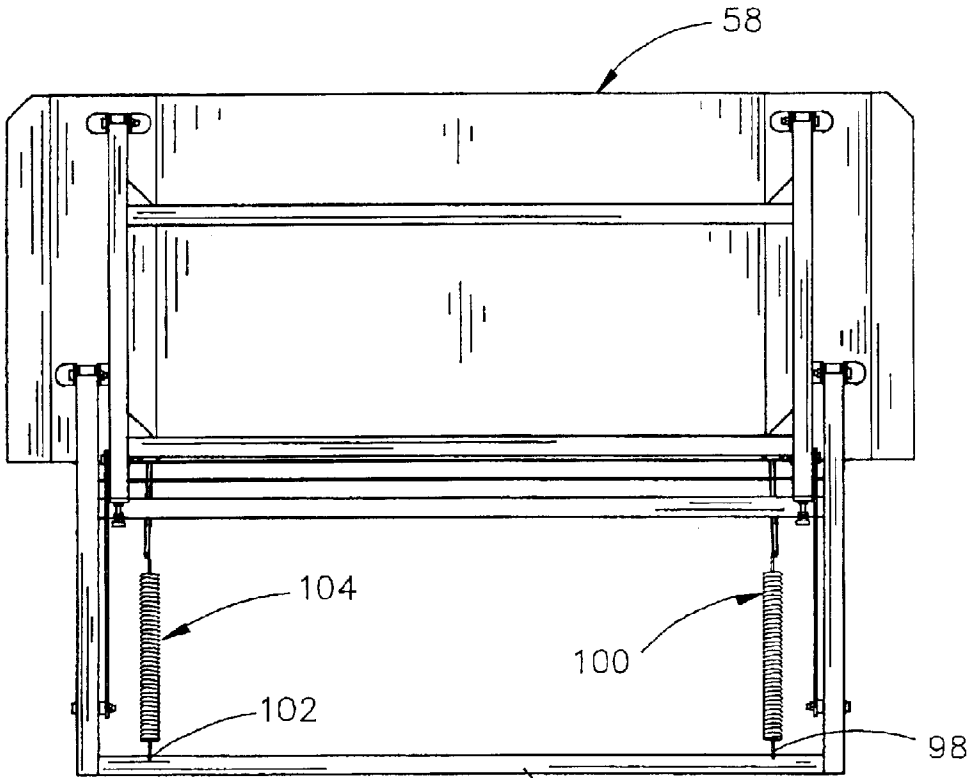
FIG. 8 is a front view of the workbench in its stored position.
Figure 9:
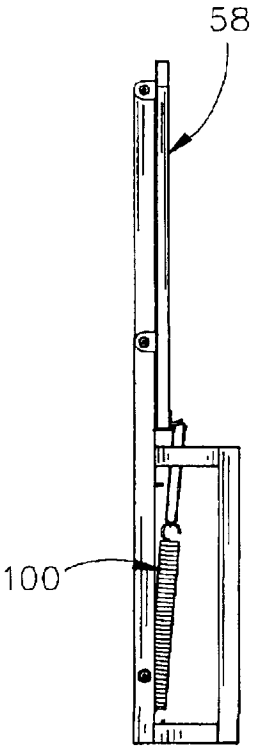
FIG. 9 is a side view of the workbench in its stored position.

The numeral 58 refers to the tabletop or table portion of the workbench 10. Table portion 58 will be described as having a top surface 60, bottom surface 62, forward edge 64, rearward edge 66, and opposite side edges 68 and 70. The rearward edge 66 of table portion 58 has an angular support 72 secured thereto by any convenient means. A pair of U-bolt connectors 74 and 76 are secured to the rearward portion of the table portion 58 and the support 72, as seen in the drawings. The U-bolt connectors 74 and 76 are the preferred connectors, but eyebolt connectors or some other type of suitable connectors may also be used. The bottom surface 62 of table portion 58 is provided with a pair of spaced-apart, flat metal plates 78 and 80 which are secured thereto by any convenient means such as screws or the like. Brackets 82 and 84 are welded or otherwise secured to the bottom surface of plate 78. The upper end of leg 34 is pivotally secured to bracket 82 by bolt assembly 86. The upper end of leg 46 is pivotally secured to bracket 84 by bolt assembly 88. Brackets 90 and 92 are welded or otherwise secured to the bottom surface of plate 80. The upper ends of legs 36 and 50 are pivotally secured to brackets 90 and 92, respectively, by bolt assemblies 94 and 96, respectively. End 98 of spring 100 is connected to frame member 37, as seen in FIG. 1. End 102 of spring 104 is also connected to frame member 37, as seen in FIG. 6. A flexible cable 106 interconnects end 108 of spring 100 to connector 74. Flexible cable 110 interconnects end 112 of spring 104 to connector 76. Although it is preferred that springs 100 and 104 be utilized, they may be replaced by bungee cords, gas cylinders such as used on vehicle hoods, hatch windows, etc. In other words, some form of lift assist is preferred but could take many forms.

The workbench 10 of this invention is selectively movable between the operative or work position of FIG. 1 to the stored or stowed position of FIG. 6. When the workbench 10 is in the work position of FIG. 1, the table portion 58 is horizontally disposed with the adjustable levelers engaging the floor. In the work position of FIG. 1, the lift assist springs 100 and 104 are in tension, the amount of which may be adjusted by varying the effective length of the cables 106 and 110. As seen, when the table portion 58 is horizontally disposed in its work position, the rearward edge 66 thereof is spaced forwardly from the wall 12.

When it is desired to store the workbench to save space in the garage or the like, the table portion is lifted from its horizontal position to its vertical position with that lifting being assisted by the lift assist mechanism in the form of springs 100 and 104. The springs 100 and 104 not only provide a lift assist but also hold the table portion in the upright position of FIG. 6. In the upright position of FIG. 6, the table portion 58 goes over center to where the springs 100 and 104 lock or hold the table portion 58 in that position. To lower the table portion 58, it must be pulled out to overcome center.

When in its stored position, the table portion 58 is spaced forwardly from the wall 12 which enables the tools on the pegboard 14 to protrude out approximately 5 inches therefrom without interference with the positioning of the table portion 58. A vise 113 with a 5-inch height may be mounted on table portion 58 and may remain thereon even when the table portion 58 is in its upright position. When the table portion 58 is in its upright stored position, the legs 46 and 50 are positioned inwardly of legs 34 and 36, respectively, therefore conserving space.

Although the structure disclosed herein is ideally suited for use as a workbench, the structure could also be used as a serving/cutting table, office table, basement craft table, shell reload table, athletic training table, meat cutting table, etc.

Thus it can be seen that the space-saver bench or table of this invention accomplishes at least all of its stated objectives.

We claim:

1. A space-saver workbench, comprising:

an upstanding framework having an upper end, a lower end, a forward end, a rearward end, and opposite sides;

a first upstanding leg at the forward end of said framework at one side thereof; said first leg having upper and lower ends;

a second upstanding leg at the forward end of same framework at the other side thereof;

said second leg having upper and lower ends;

said upper ends of said first and second legs being disposed above the upper end of said framework;

a table portion having a top surface, a bottom surface, a forward end, a rearward end, and opposite sides;

said upper ends of said first and second legs being pivotally secured to said table portion forwardly of the rearward end thereof;

a first elongated arm having first and second ends;

a second elongated arm having first and second ends;

said first end of said first arm being pivotally secured to said first leg;

said first end of said second arm being pivotally secured to said second leg;

a third leg having upper and lower ends;

a fourth leg having upper and lower ends;

said upper ends of said third and fourth legs being pivotally secured to said table portion forwardly of the pivotal connection of said first and second legs with said table portion;

said second ends of said first and second arms being pivotally secured to said third and fourth legs, respectively;

a lift assist extending between said framework and said table portion adjacent said rearward end thereof.

2. The space-saver workbench of claim 1 wherein said table portion is selectively movable between a horizontal work position to an upright stored position.

3. The space-saver workbench of claim 2 wherein said lift assist assists the movement of said table portion from its said work position to its said stored position.

4. The space-saver workbench of claim 2 wherein said lift assist yieldably maintains said table portion in its stored position.

5. The space-saver workbench of claim 2 wherein said lift assist comprises at least two elongated spring members.

6. The space-saver workbench of claim 2 wherein said lift assist comprises an elongated spring means secured at one end to said framework and secured at its other end to said table portion.

7. The space-saver workbench of claim 6 wherein said other end of said spring means is connected to said table portion by means of a flexible cable extending there between.

8. The space-saver workbench of claim 7 wherein said flexible cable is selectively length adjustable.

9. The space-saver workbench of claim 6 wherein a first frame member extends between said first and second legs and wherein said one end of said spring means is connected to said first frame member.

10. The space-saver workbench of claim 2 wherein said bottom surface of said table portion has first and second flat plates secured thereto in a spaced-apart relation and wherein said upper ends of said first and third legs are pivotally secured to said first plate and wherein said upper ends of said second and fourth legs are pivotally secured to said second plate.

11. The space-saver workbench of claim 2 wherein the distance between said third and fourth legs is less than the distance between said first and second legs.

12. The space-saver workbench of claim 2 wherein said table portion is spaced forwardly of said rearward end of said framework when said table portion is in its said stored position.

13. The space-saver workbench of claim 2 wherein said rearward end of said table portion is spaced above the upper end of said framework when said table portion is in its said stored position.

14. The space-saver workbench of claim 6 wherein a reinforcing member is secured to said rearward end of said table portion and wherein said second end of said spring means is operatively connected to said reinforcing member.

15. The space-saver workbench of claim 2 wherein a brace means extends between said third and fourth legs.

16. A folding table, comprising:

a support having an upper end, a lower end, a forward end, a rearward end, and opposite sides;

first and second legs, having upper and lower ends, at the forward end of said support;

a table top having a top surface, a bottom surface, a forward end, a rearward end, and opposite sides;

said upper ends of said first and second legs being pivotally secured to said table top forwardly of the rearward end thereof;

a first elongated arm having first and second ends;

a second elongated arm having first and second ends;

said first end of said first arm being pivotally secured to said first leg;

said first end of said second arm being pivotally secured to said second leg;

a third leg having upper and lower ends;

a fourth leg having upper and lower ends;

said upper ends of said third and fourth legs being pivotally secured to said table top forwardly of the pivotal connection of said first and second legs with said table top;

said second ends of said first and second arms being pivotally secured to said third and fourth legs, respectively;

a lift assist extending between said support and said table top adjacent said rearward end thereof.

17. The folding table of claim 16 wherein said table top is selectively movable between a horizontal work position to an upright stored position.

18. The folding table of claim 16 wherein said lift assist assists the movement of said table top from its said work position to its said stored position.

19. The folding table of claim 16 wherein said lift assist yieldably maintains said table top in its stored position.

20. The folding table of claim 16 wherein said lift assist comprises at least two elongated spring members.

21. The folding table of claim 16 wherein said lift assist comprises an elongated spring means secured at one end to said support and secured at its other end to said table top.

22. The folding table of claim 21 wherein said other end of said spring means is connected to said table top by means of a flexible cable extending therebetween.

23. The folding table of claim 22 wherein said flexible cable is selectively length adjustable.

24. The folding table of claim 21 wherein a first frame member extends between said first and second legs and wherein said one end of said spring means is connected to said first frame member.

25. The folding table of claim 16 wherein said bottom surface of said table top has first and second flat plates secured thereto in a spaced-apart relation and wherein said upper ends of said first and third legs are pivotally secured to said first plate and wherein said upper ends of said second and fourth legs are pivotally secured to said second plate.

26. The folding table of claim 16 wherein the distance between said third and fourth legs is less than the distance between said first and second legs.

27. The folding table of claim 16 wherein said table top is spaced forwardly of said rearward end of said support when said table top is in its said stored position.

28. The folding table of claim 27 wherein said rearward end of said table top is spaced above the upper end of said support when said table top is in its said stored position.

* * * * *